US009784429B2

(12) United States Patent
Lv et al.

(10) Patent No.: US 9,784,429 B2
(45) Date of Patent: Oct. 10, 2017

(54) METHOD AND DEVICE FOR GREATLY INCREASING IRRADIATION RANGE OF STREET LAMP

(71) Applicant: HONGLI LINGHTING GROUP CO., LTD., Jiangsu (CN)

(72) Inventors: Guofeng Lv, Yixing (CN); Wenqing Lv, Yixing (CN)

(73) Assignee: HONGLI LIGHTING GROUP CO., LTD., Yixing (CN)

( * ) Notice: Subject to any disclaimer, the term of this patent is extended or adjusted under 35 U.S.C. 154(b) by 67 days.

(21) Appl. No.: 14/913,405

(22) PCT Filed: Nov. 27, 2014

(86) PCT No.: PCT/CN2014/092328

§ 371 (c)(1),
(2) Date: Feb. 22, 2016

(87) PCT Pub. No.: WO2015/090134

PCT Pub. Date: Jun. 25, 2015

(65) Prior Publication Data

US 2017/0254505 A1 Sep. 7, 2017

(30) Foreign Application Priority Data

Dec. 16, 2013 (CN) ..... 2013 1 0690220

(51) Int. Cl.
*F21V 5/04* (2006.01)
*F21S 8/08* (2006.01)
(Continued)

(52) U.S. Cl.
CPC ..... *F21V 5/04* (2013.01); *F21S 8/085* (2013.01); *F21W 2131/103* (2013.01); *F21Y 2115/10* (2016.08)

(58) Field of Classification Search
CPC ... F21V 5/04; F21V 5/08; F21V 5/008; F21V 5/048; F21V 5/00; F21S 8/085;
(Continued)

(56) References Cited

U.S. PATENT DOCUMENTS 7,798,679 B2 * 9/2010 Kokubo ..... G02B 19/0014 362/334
8,292,474 B2 * 10/2012 Ho ..... F21V 5/04 362/311.02

(Continued)

FOREIGN PATENT DOCUMENTS

CN 101660705 A 3/2010
CN 101915391 A 12/2010

(Continued)

OTHER PUBLICATIONS

The World Intellectual Property Organization (WIPO) International Search Report for PCT/CN2014/092328 dated Mar. 4, 2015.

*Primary Examiner* — Bao Q Truong
(74) *Attorney, Agent, or Firm* — Anova Law Group, PLLC

(57) ABSTRACT

The invention provides a method and a device for greatly increasing an irradiation range of a lamp. The method is characterized as follows: firstly, a COB module LED point light source is adopted as a light source; secondly, the LED point light source is put into an incident concave surface (11) to be covered by the same, so that the LED point light source is primarily refracted by the incident concave surface (11); thirdly, a light-distribution free curved surface (12) is further arranged to cover the incident concave surface (11), so that the light ray primarily refracted by the incident concave surface (11) is subsequently refracted by the light-distribution free curved surface (12) to deflect by a large angle; after two refractions, the included angle between a position, perpendicular to an extension direction of a road, of the peak intensity and an optical axis ranges from 60 to 75 degrees and a light distribution angle in a direction in accordance with the extension direction of the road ranges from 120 to 150 degrees, whereby the illumination of one single COB module LED point light source to at least 6 lanes and
(Continued)

illumination at an interval of at least 35 m or long-distance illumination of a high-pole lamp are realized. The method and the device of the present invention are capable of realizing the illumination of one single lamp to at least 6 lanes.

4 Claims, 7 Drawing Sheets

(51) Int. Cl.
*F21W 131/103* (2006.01)
*F21Y 115/10* (2016.01)

(58) Field of Classification Search
CPC ... F21S 8/086; F21Y 2115/10; F21Y 2101/00; F21W 2131/103; Y02B 20/72
See application file for complete search history.

(56) References Cited

U.S. PATENT DOCUMENTS

| | | | | |
|---|---|---|---|---|
| 9,638,393 | B2 * | 5/2017 | Lv | F21V 5/08 |
| 2010/0033944 | A1 * | 2/2010 | Ho | F21V 5/04 362/19 |
| 2011/0320024 | A1 * | 12/2011 | Lin | F21V 5/04 700/98 |
| 2014/0328062 | A1 * | 11/2014 | Ikeda | G02B 19/0066 362/237 |

FOREIGN PATENT DOCUMENTS

| | | | |
|---|---|---|---|
| CN | 203147627 | U | 8/2013 |
| CN | 103307548 | U | 9/2013 |
| CN | 103375769 | A | 10/2013 |
| CN | 203323002 | U | 12/2013 |
| CN | 103644532 | A | 3/2014 |
| CN | 203797558 | U | 8/2014 |
| JP | 2012186019 | A | 9/2012 |

* cited by examiner

METHOD AND DEVICE FOR GREATLY INCREASING IRRADIATION RANGE OF STREET LAMP

CROSS-REFERENCES TO RELATED APPLICATIONS

This application is a national stage patent application of PCT application No. PCT/CN2014/092328, filed on Nov. 27, 2014. This application claims priority to Chinese Patent Application No. 201310690220.7, filed on Dec. 16, 2013, the entire content of which is incorporated herein by reference.

FIELD OF THE INVENTION

The present disclosure generally relates to a lighting technology, in particular relates to a method and a device capable of realizing road illumination to at least 6 lanes with an interval of less than 45 m through one single light source or high-pole lamp illumination by virtue of a light distribution technology, and specifically relates to a method and a device for greatly increasing the irradiation range of a lamp.

BACKGROUND

Currently, the required illumination distance of a street lamp is at least 75 m, while a light-distribution deflection angle of an optical lens or a reflecting cup is insufficient, therefore, the existing LED high-pole lamps for plaza illumination are often mounted at a large elevation angle, and light emitted from the LED high-pole lamps can be projected onto the ground opposite to a lamp pole. In addition, a large amount of light emitted from the LED high-pole lamps is directly projected to the sky, causing light pollution.

The LED high-pole lamps for plaza illuminations often have high powers and, meanwhile, a large number of lamps are required to be circumferentially mounted on one lamp pole within 360 degrees. Thus, strong glare is often generated by the high-pole lamps and directly emitted to the sky, which adversely affects airplanes flying at high altitudes. For example, pilots may erroneously identify it as navigation lights. Further, the strong light emitted to the sky illuminates the clouds, forming noisy background light and blocking the starlight. Accordingly, the primary color of the night sky is changed, and the quiet atmosphere of the night is weakened.

Further, secondary optical lenses of the existing LED street lamps for road illumination are substantially designed to meet the requirement of 2-5 lanes, i.e., illuminate 2-5 lanes. In a direction vertical to the road, the deflection angles of the optical lenses are substantially within the range of 30 to 50 degrees. Due to the insufficient deflection angles, the light emitted by the optical lenses cannot reach as far as 6-7 lanes, thus fails to meet the road illumination requirement of 6-7 lanes.

The disclosed methods and devices are directed to solve one or more problems set forth above and other problems.

BRIEF SUMMARY OF THE DISCLOSURE

One aspect of the present disclosure includes a method for greatly increasing an irradiation range of a street lamp or a high-pole lamp. The method includes: firstly, a COB module LED area light source is adopted as a light source; secondly, the LED area light source is put into an incident concave surface to be covered by the same, so that the LED point light source is primarily refracted by the incident concave surface; thirdly, a light-distribution free curved surface is further arranged to cover the incident concave surface, so that the light ray primarily refracted by the incident concave surface is subsequently refracted by the light-distribution free curved surface to deflect by a large angle.

After two refractions, an included angle between a position, perpendicular to an extension direction of a road, of the peak intensity and an optical axis ranges from 60 to 75 degrees and a light distribution angle in a direction in accordance with the extension direction of the road ranges from 120 to 150 degrees, whereby the illumination of one single COB module LED point light source to at least 6 lanes and illumination at an interval of at least 35 m or long-distance illumination of a high-pole lamp are realized.

The coordinate value of each point (x,y) on a section profile line, extending in the direction perpendicular to the extension direction of the road and passing the COB module LED point light source, of the light-distribution free curved surface is determined by the following light distribution condition of one single light ray:

$$\theta 2 = -\tan^{-1}\left\{\tan\xi 1 - \frac{(\alpha + 90^\circ)}{180^\circ} \cdot [\tan\xi 1 + \tan\xi 2]\right\} \quad \text{Formula (1)}$$

wherein θ2 represents an included angle between an emergent ray and an optical axis OZ when the included angle between an incident ray OP and the optical axis OZ is α; OP represents the light ray OP emitted from the center point O of the COB module LED and incident into the incident concave surface (11); OZ represents an axis passing the center point O of the COB module LED and perpendicular to a mounting bottom surface thereof.

A refracted ray PQ passes the light-distribution free curved surface (12) for light distribution and is emergent as a light ray QS after light distribution; −ξ1 and ξ2 represent the maximum deflection angles expected to be obtained at the maximum light distribution angle of a marginal ray when the incident angle α is −90 degrees and +90 degrees, and the absolute values of the maximum deflection angles range from 60 to 75 degrees. The light distribution angle θ2 of the deflected emergent ray QS falls into a range of −ξ1 to ξ2.

The positive and negative signs of the angles are herein defined as follows: a light ray deflecting toward the left of the optical axis OZ is negative, while a light ray deflecting toward the right of the optical axis OZ is positive. The numerical area of α ranges from −ξ1 to ξ2; the section profile line, extending in the direction perpendicular to the extension direction of the road and passing the COB module LED point light source, of the incident curved surface is composed of a segment of inclined elliptical arc A-B-C and a segment of arc C-D. The long axis of the elliptical arc A-B-C is OC, while the short axis thereof is OB; the value of the OC is 1-1.5 times the diameter of the area light source; the ratio OC/OB of the long axis to the short axis is between 1.2-2.5; the short axis OB has an inclination angle and an included angle between the short axis OB and the optical axis OZ is τ of which the numerical area ranges from 15 to 20 degrees.

The arc is tangent with the inclined elliptical arc, the diagonal lines OL and OF, on a side close to A, of the incident concave surface are longer, while the diagonal lines OJ and OH, on a side close to D, of the same are shorter, and the ratio OL/OJ ranges from 1.1 to 1.3; the incident concave surface (11) and the light-distribution free curved surface (12) are formed by scanning the sectional curve along a curve determined according to the following condition:

$$\theta 1 = \tan^{-1}\left[\frac{\beta}{90^\circ} \cdot \tan\psi\right] \quad \text{Formula (2)}$$

wherein ψ represents the maximum light distribution angle of the edge ray required when the incident angle β of the incident concave surface is +/−90 degrees; the light distribution angle θ1 falls into a range from the included angle of the optical axis and +/−ψ; the positive and negative signs of the light angles are defined as the same herein: the light ray deflecting toward the left of the optical axis OZ is negative, while the light ray deflecting toward the right of the optical axis OZ is positive. The diameter of the COB module LED area light source is smaller than 30 mm.

Another aspect of the present disclosure includes a street lamp lens or a high-pole lamp lens with significantly increased the irradiation range. The street lamp lens or a high-pole lamp lens includes a COB module LED light source, wherein the COB module LED light source is covered with a primary incident concave lens which is covered with a light-distribution curved lens; in a direction (Y-Y) perpendicular to a road. An included angle between a direction of a deflection angle of a light distribution curve of the light-distribution curved lens in a position of the peak intensity, and an optical axis ranges from 60 to 75 degrees.

In a direction (X-X) along the road, a light distribution angle of the light-distribution curved lens ranges from 120 to 150 degrees. The coordinate value of each point (x,y) on a section profile line, extending in the direction perpendicular to the extension direction of the road and passing the COB module LED point light source, of the light-distribution curved lens is determined by the following light distribution condition of one single light ray:

$$\theta 2 = -\tan^{-1}\left\{\tan\xi 1 - \frac{(\alpha + 90^\circ)}{180^\circ} \cdot [\tan\xi 1 + \tan\xi 2]\right\} \quad \text{Formula (1)}$$

wherein θ2 represents an included angle between an emergent ray and an optical axis OZ when the included angle between an incident ray OP and the optical axis OZ is α; OP represents the light ray OP emitted from the center point O of the COB module LED and incident into an incident concave surface (11); OZ represents an axis passing the center point O of the COB module LED and perpendicular to a mounting bottom surface thereof.

A refracted ray PQ passes a light-distribution free curved surface (12) for light distribution and is emergent as a light ray QS after light distribution; −ξ1 and ξ2 represent the maximum deflection angles expected to be obtained at the maximum light distribution angle of a marginal ray when the incident angle α is −90 degrees and +90 degrees. The absolute values of the maximum deflection angles range from 60 to 75 degrees; the light distribution angle θ2 of the deflected emergent ray QS falls into a range of −ξ1 to ξ2.

The positive and negative signs of the angles are herein defined as follows: a light ray deflecting toward the left of the optical axis OZ is negative, while a light ray deflecting toward the right of the optical axis OZ is positive. The numerical area of α ranges from −ξ1 to ξ2; the section profile line, extending in the direction perpendicular to the extension direction of the road and passing the COB module LED point light source, of the primary incident concave lens is composed of a segment of inclined elliptical arc A-B-C and a segment of arc C-D. The long axis of the elliptical arc A-B-C is OC, while the short axis thereof is OB; the value of the OC is 1-1.5 times the diameter of the area light source; the ratio OC/OB of the long axis to the short axis is between 1.2-2.5. The short axis OB has an inclination angle and the included angle between the short axis OB and the optical axis OZ is τ of which the numerical area ranges from 15 to 20 degrees.

The arc is tangent with the inclined elliptical arc, the diagonal lines OL and OF, on a side close to A, of the incident concave surface (11) are longer, while the diagonal lines OJ and OH, on a side close to D, of the same are shorter, and the ratio OL/OJ ranges from 1.1 to 1.3. The primary incident concave lens and the light-distribution curved lens are formed by scanning the sectional curve along a curve determined according to the following condition:

$$\theta 1 = \tan^{-1}\left[\frac{\beta}{90^\circ} \cdot \tan\psi\right] \quad \text{Formula (2)}$$

wherein ψ represents the maximum light distribution angle of the edge ray required when the incident angle β of the incident concave surface (11) is +/−90 degrees.

The light distribution angle θ1 falls into a range from the included angle of the optical axis and +/−ψ. The positive and negative signs of the light angles are defined as the same herein: the light ray deflecting toward the left of the optical axis OZ is negative, while the light ray deflecting toward the right of the optical axis OZ is positive. The street lamp lens or the high-pole lamp lens capable of greatly increasing the irradiation range of the street lamp of claim 1, wherein the light-distribution free curved surface is approximately 102.2092285 mm in width and approximately 50.8887939 mm in height, and the errors of all the dimensions are approximately +/−1 mm.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. It is apparent that the described embodiments are some but not all of the embodiments of the present invention. Based on the disclosed embodiments, persons of ordinary skill in the art may derive other embodiments consistent with the present disclosure, all of which are within the scope of the present invention.

The present disclosure provides a method for greatly increasing the irradiation range of a lamp, which is directed to solve the problem that the existing LED illuminating street lamps are not able to satisfy the illumination of street lamps on one single side to more than 6 lanes or plaza illumination due to unreasonable design of the secondary optical lenses.

The present invention is further described below by combining the accompanying drawings FIGS. 1-12 and embodiments.

Figure 1:
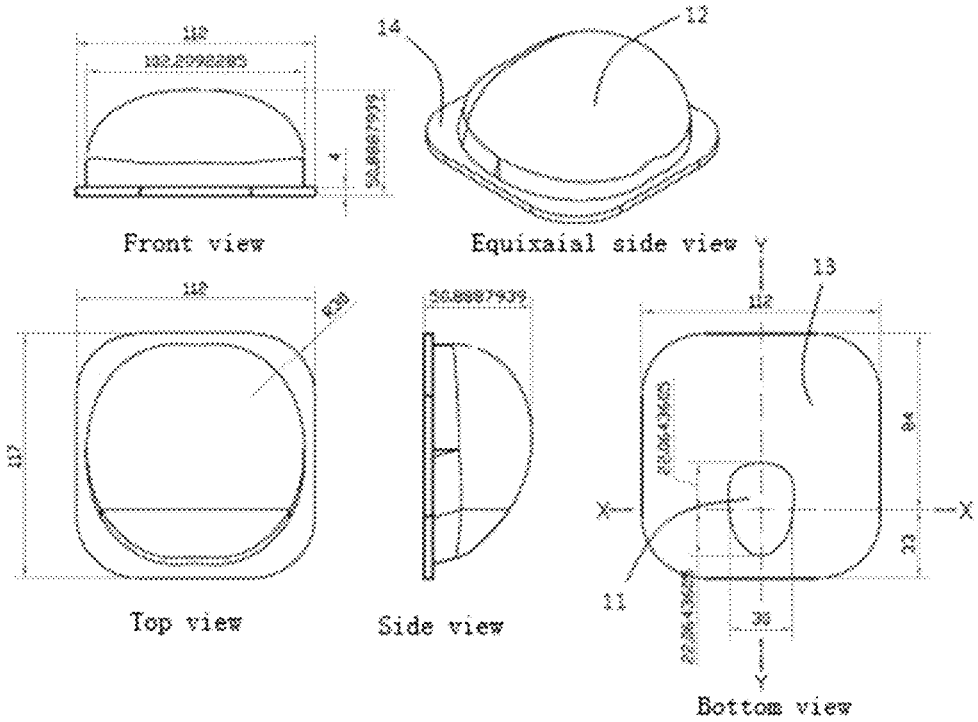
FIG. 1 is a structural schematic diagram of the present invention.

The structural schematic diagram of the double lens with secondary light distribution of the present invention is as shown in FIG. 1. It is composed of the bottom goose-egg-shaped incident concave surface 11, the light-distribution free curved surface 12 arranged above, a bottom plane 13, and a square platform 14 for mounting.

Figure 2:
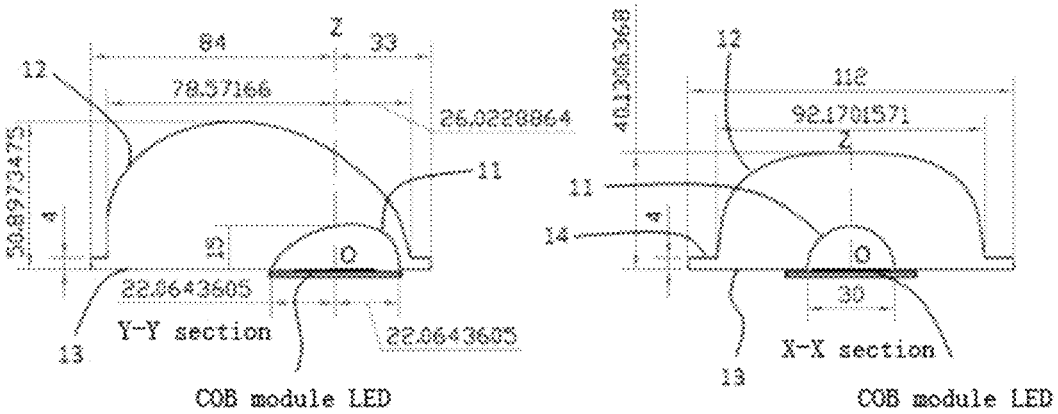
FIG. 2 is a sectional drawing of the street lamp as shown in FIG. 1 in the Y-Y direction and the X-X direction.

Its sectional drawing in the Y-Y direction and the X-X direction is as shown in FIG. 2. The incident concave surface 11 is deeper on one side and shallower on the other side, while the light-distribution free curved surface 12 is relatively inclined on one side in a direction opposite to the incident concave surface and relatively convex on the other side. The optical axis OZ passes the center of a COB module LED light-emitting surface and is vertical to the COB module LED light-emitting surface, and deviates toward the relatively inclined side of the light-distribution free curved surface 12. The so-called COB module LED represents Chips on board in English, namely, an integrated light source with a lot of chips integrated on the same printed circuit board; the diameter of the light-emitting surface is within ϕ30 mm, and preferably, the diameter of the light-emitting surface is ϕ28 mm herein.

The size of the square platform 14 for mounting is not limited, and preferably, the length and width are 112 mm*117 mm and each of the four corners is provided with an R30 mm chamfer herein. The light-distribution free curved surface 12 is as shown in FIG. 1, which is less than 120 mm in length and width and less than 55 mm in height. Preferably, the light-distribution free curved surface 12 is 102.2092285 mm in width and 50.8887939 mm in height, and the errors of all the dimensions are +/−1 mm.

Figure 3:
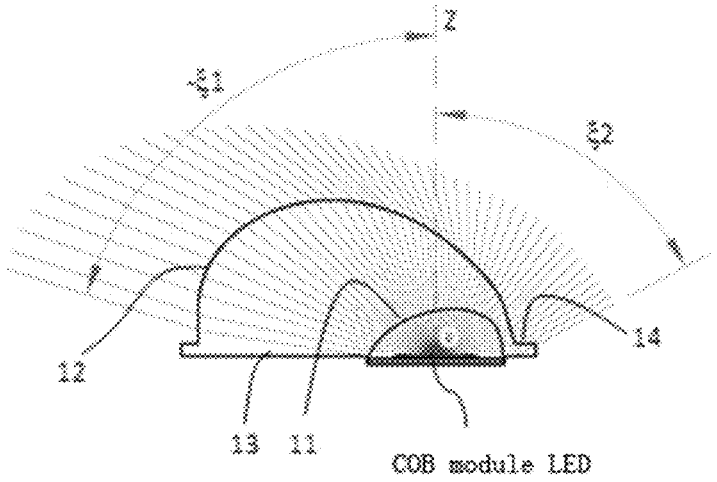
FIG. 3 is a schematic diagram of a light distribution principle of the street lamp as shown in FIG. 1 in the Y-Y section.

The light distribution principle of the secondary optical lens of the present invention in the Y-Y section is as shown in FIG. 3. All the light rays emitted from the center point O of the COB module LED light-emitting surface is refracted by the concave surface 11 and distributed through the free light-distribution curve 12 arranged above. The emergent rays after light distribution are distributed within a range of an included angle between −ξ1 and ξ2 with the optical axis, wherein −ξ1 is greater than or equal to −75 degrees and less than or equal to −65 degrees, while ξ2 is greater than or equal to 55 degrees and less than or equal to 65 degrees; preferably in the embodiment, −ξ1 is −72.5 degrees, while ξ2 is 62.5 degrees.

Figure 4:
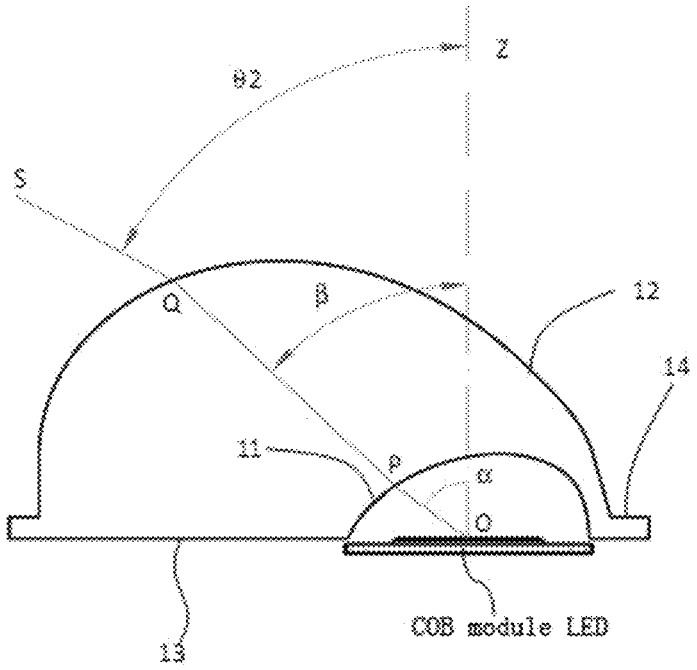
FIG. 4 is a schematic diagram of light distribution of the street lamp as shown in FIG. 1 to one single light ray in the Y-Y section.

Light distribution of the secondary optical lens of the present invention to one single light ray in the Y-Y section is as shown in FIG. 4. The light ray OP emitted from the center point O of the COB module LED is incident into the concave surface 11; the refracted ray PQ is distributed through the light-distribution free curved surface 12 arranged above, and emergent as the light ray QS after light distribution. Assume that the included angle between the incident ray OP and the optical axis OZ is α and the included angle between the emergent ray and the optical axis OZ is θ2, the emergent angle θ2 and the incident angle α satisfy the following light distribution condition:

$$\theta 2 = -\tan^{-1}\left\{\tan\xi 1 - \frac{(\alpha + 90^\circ)}{180^\circ}\cdot[\tan\xi 1 + \tan\xi 2]\right\} \qquad \text{Formula (1)}$$

In Formula (1), −ξ1 and ξ2 represent the maximum light distribution angles of the marginal ray when the incident angle α is −90 degrees and +90 degrees; preferably in the present invention, −ξ1 is −72.5 degrees, while ξ2 is 62.5 degrees; the light distribution angle θ2 of the emergent ray QS after light distribution is distributed within the range of the included angle between −ξ1 and ξ2 with the optical axis. The positive and negative signs of the angles are herein defined as follows: the light ray deflecting toward the left of the optical axis OZ is negative, while the light ray deflecting toward the right of the optical axis OZ is positive.

Figure 5:
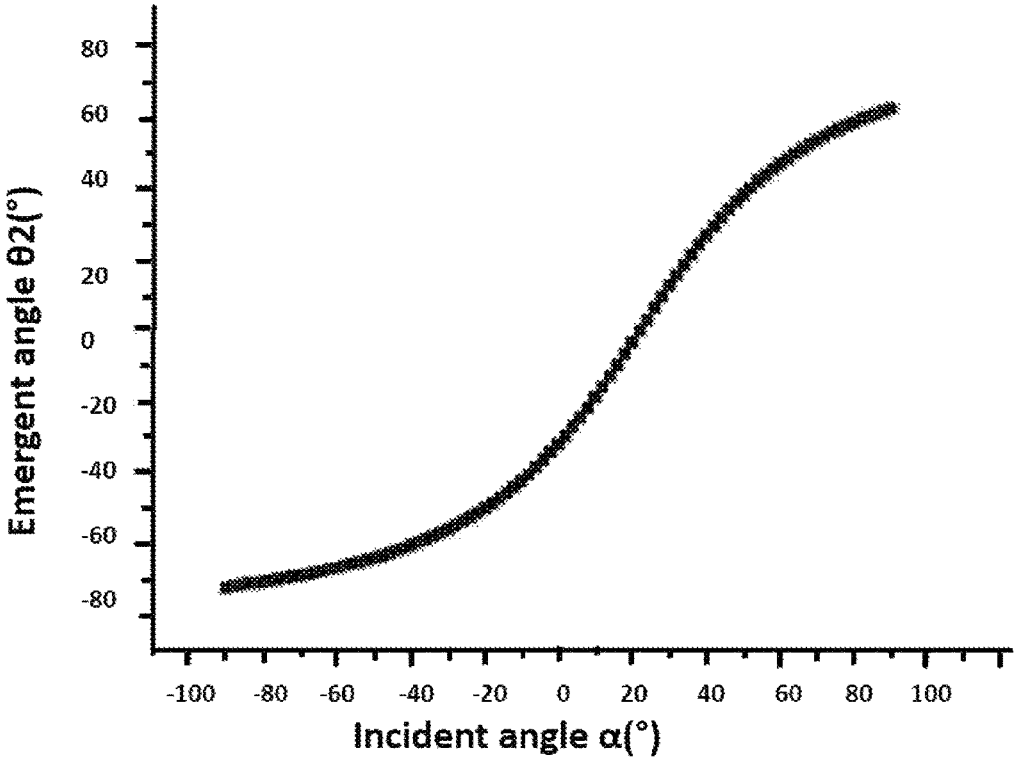
FIG. 5 is a schematic diagram of a relation curve between an emergent angle θ2 and an incident angle α during light distribution of the street lamp as shown in FIG. 1 to one single light ray in the Y-Y direction.

According to the Formula (1), the relation curve between the emergent angle θ2 and the incident angle α is as shown in FIG. 5. The coordinate value of each point (X,Y) on the Y-Y section profile line of the light-distribution free curved surface 12 can be calculated by use of the prior art and according to the light distribution condition; to increase the speed, computer programming can be adopted. The higher the value of α is, the higher the precision of the fitted curve is and the better the light distribution effect is.

Figure 6:
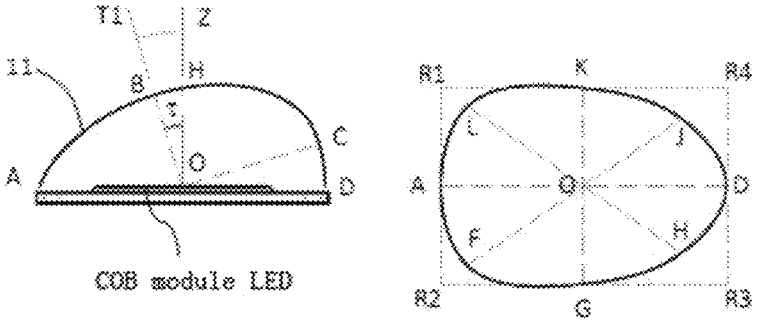
FIG. 6 shows a sectional drawing and a bottom view of the incident concave surface 11 of the present invention in the Y-Y direction.

It can be seen from FIG. 1 and FIG. 6 that the incident concave surface 11 of the present invention is of a goose-egg-shaped structure as a whole, and the view of the incident concave surface 11 in the Y-Y section and the bottom surface is as shown in FIG. 6. The line segment A-B-C of the incident concave surface 11 in the contour line of the Y-Y section is a segment of inclined elliptical arc with the long axis of OC and the short axis of OB. The value of OC is 1-1.5 times the diameter of the COB module LED area light source. The ratio OC/OB of the long axis to the short axis is between 1.2-2.5, preferably 1.6 herein. The short axis OB has an inclination angle and the included angle between the short axis OB and the optical axis OZ is τ of which the numerical area can be between 15 and 20 degrees; preferably in the invention, the inclination angle $\tau$ is 17.5 degrees.

The line segment CD is a segment of arc centered on the point O, and is tangent with the inclined elliptical arc A-B-C at the point C. In a bottom view on the right side of FIG. 6, the diagonal lines OL and OF, on a side close to A, of the incident concave surface 11 are longer, while the diagonal lines OJ and OH, on a side close to D, of the same are shorter, and the ratio OL/OJ ranges from 1.1 to 1.3, preferably 1.2.

Figure 7:
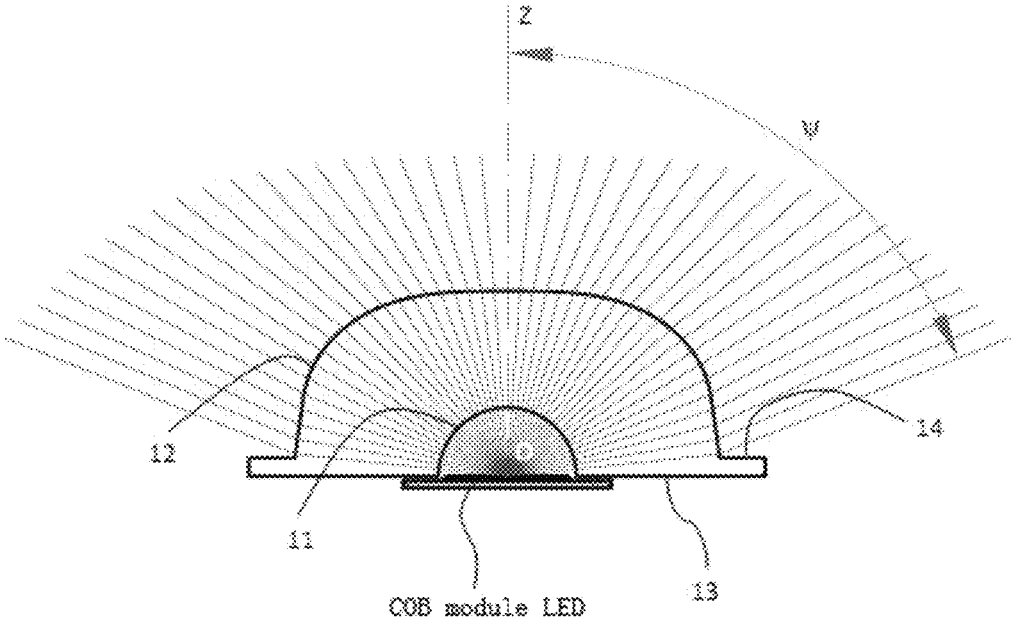
FIG. 7 is a schematic diagram of a section of the street lamp as shown in FIG. 1 in the X-X direction and a light distribution principle.

The light distribution principle of the secondary optical lens of the present invention in the X-X section is as shown in FIG. 7. All the light rays emitted from the center point O of the COB module LED light-emitting surface are refracted by the concave surface 11 and then distributed through the free light-distribution curve 12 arranged above, and the emergent rays after light distribution are distributed within a range of an included angle between $-\psi$ and $+\psi$ with the optical axis, wherein $\psi$ is greater than or equal to 60 degrees and less than or equal to 75 degrees, preferably 70 degrees.

Figure 8:
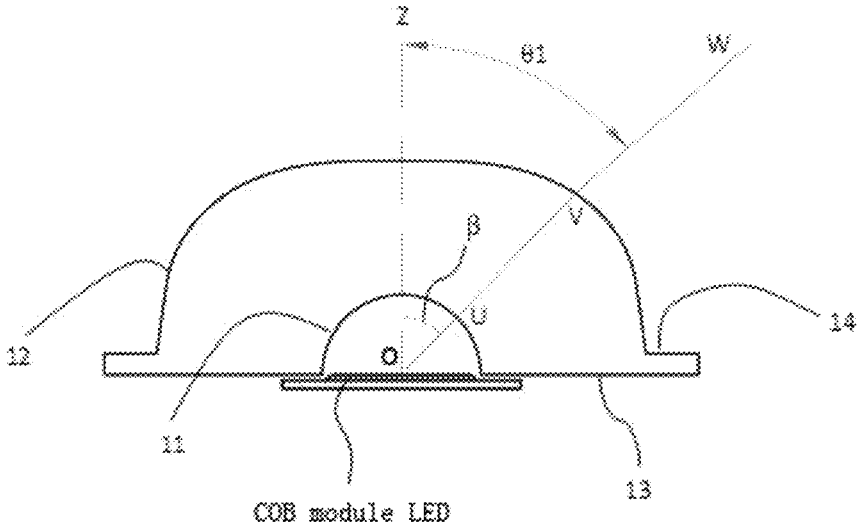
FIG. 8 is a schematic diagram of light distribution of one single light ray in FIG. 7.

Light distribution of the secondary optical lens of the present invention to one single light ray in the X-X section is as shown in FIG. 8. The light ray OU emitted from the center point O of the COB module LED is incident into the concave surface 11; the refracted light UV is distributed through the light-distribution free curved surface 12 arranged above, and is emergent as the emergent ray VW after light distribution.

Assume that the included angle between the incident ray OU and the optical axis OZ is $\beta$ and the included angle between the emergent ray VW and the optical axis OZ is $\theta 1$, the emergent angle $\theta 1$ and the incident angle $\beta$ satisfy the following light distribution condition:

$$\theta 1 = \tan^{-1}\left[\frac{\beta}{90^\circ} \cdot \tan\psi\right] \qquad \text{Formula (2)}$$

In Formula (2), $\psi$ represents the maximum light distribution angle of the edge ray required when the incident angle $\beta$ is +/−90 degrees as shown in FIG. 7, and $\psi$ is preferably 70 degrees in the present invention; the light distribution angle $\theta 1$ of the emergent ray VW after light distribution falls into a range of an included angle between $-\psi$ and $+\psi$ with the optical axis.

The positive and negative signs of the light angles are defined as the same herein: the light ray deflecting toward the left of the optical axis OZ is negative, while the light ray deflecting toward the right of the optical axis OZ is positive.

Figure 9:
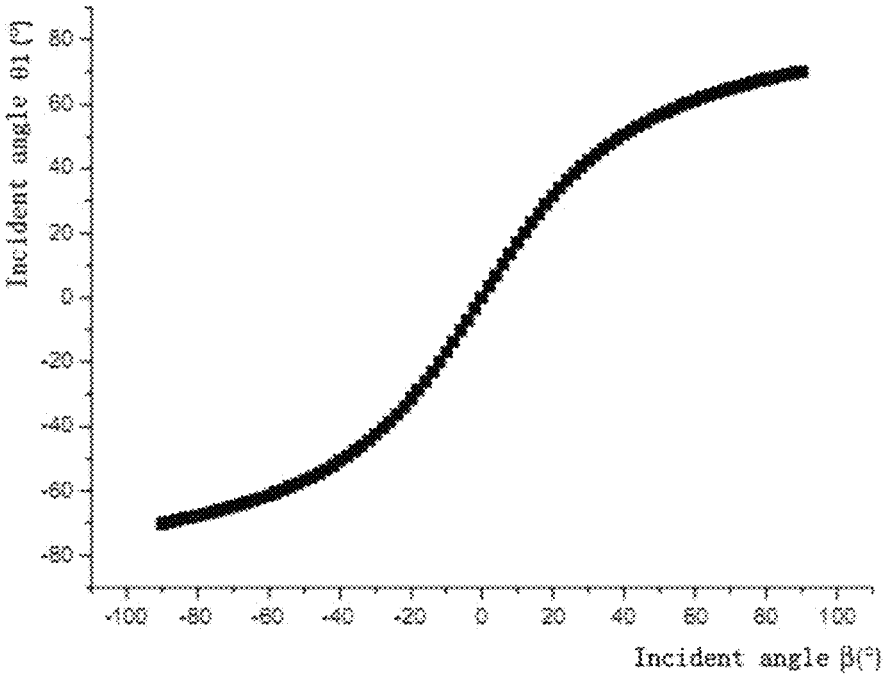
FIG. 9 is a schematic diagram of a relation curve between an emergent angle θ1 and an incident angle β during light distribution of the one single light ray as shown in FIG. 8.

According to Formula (2), the relation curve between the light distribution angle $\theta 1$ and the incident angle $\beta$ is as shown in FIG. 9. The coordinate value of each point (X,Y) on the X-X section profile line of the light-distribution free curved surface 12 can be calculated according to the above light distribution condition, based on computer programming and by use of a mathematical iterative method. The higher the value of $\beta$ is, the higher the precision of the fitted section curve of the curved surface 12 as shown in FIG. 7 is. It can be seen from FIGS. 7 and 8 that the section curve of the curved surface 11 is an arc line of which the diameter is equal to OC.

The fitted section line of the curved surface 12 as shown in FIG. 4 and the section line of the incident surface 11 as shown in FIG. 4 are scanned on the fitted curves as shown in FIG. 8, and then the desired incident concave surface 11 and the light-distribution free curved surface 12 can be established; the formed light spots are also substantially square.

Computer simulation and photometric analysis of the secondary optical lens of the present invention are described below under the following assumptions: the COB module LED is 250 W with the luminous flux of 25000 lumens, the size of the light-emitting surface is $\phi$28 mm, the elevation angle of the lens is 0 degree and the screen is placed at the distance of 10 m.

Figure 10:
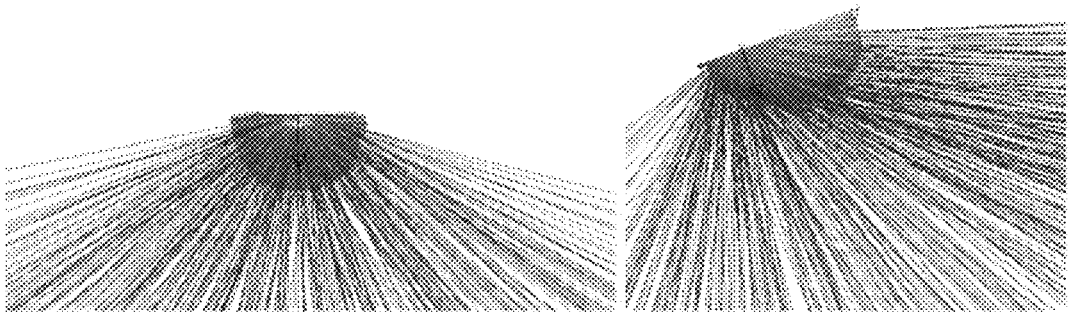
FIG. 10 is a schematic diagram of ray tracing of the street lamp of the present invention.

FIG. 10 shows the ray tracing of a specific embodiment of the secondary optical lens of the present invention. It can be seen that the beam divergence angle of the lens in the X-X direction (as shown in the left figure) is very large, but in the Y-Y direction (as shown in the right figure), the light of the lens is projected slantwise at a large angle.

Figure 11:
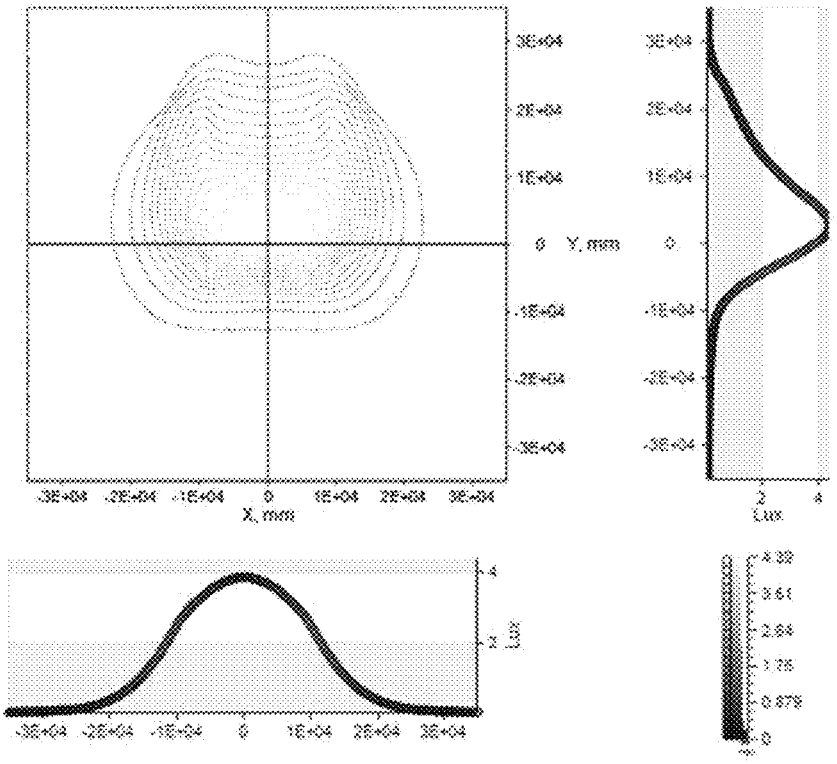
FIG. 11 is a schematic diagram of a light spot shape at a distance of 10 m and illumination distribution of the street lamp as shown in FIG. 1.

FIG. 11 shows the light spot shape and the illumination distribution of the specific embodiment of the secondary optical lens of the present invention at the distance of 10 m; a spot diagram is in asymmetrical distribution and the center of each spot is not in the intersection position of spider lines.

Figure 12:
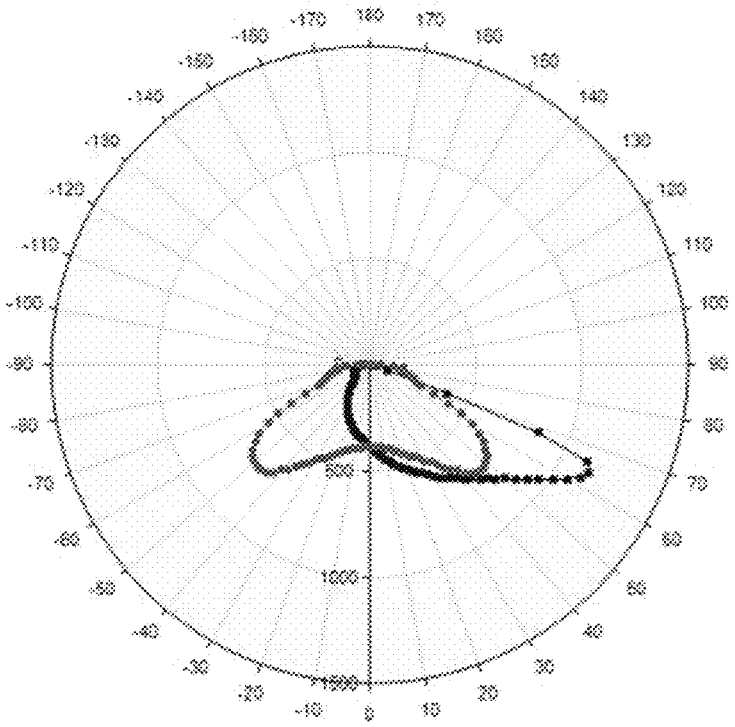
FIG. 12 is a schematic diagram of the light distribution curve (the far-end angle distribution of the light intensity) of the present invention.

FIG. 12 shows the light distribution curve of the specific embodiment of the secondary optical lens of the present invention. It can be seen that the light distribution curve is in batwing distribution in the X-X direction with the beam angle of +/−70.4451648489361450 degrees (the full beam angle is about 140 degrees), and in the Y-Y direction, the light distribution curve has a very large deflection angle and deviates from the axis by about 68 degrees at the position of the maximum peak intensity; as a result, an anticipatory goal is achieved.

The present invention has the following beneficial effects. It is realized in the present invention that the light distribution curve of the lens in the direction (Y-Y) vertical to the road has a very large deflection angle and the included angle between the position of the peak intensity of the lens and the optical axis ranges from 60 to 75 degrees; when the lens is mounted on a high-pole lamp with a height of 20 m, it is capable of uniformly illuminating the ground above a range of 40-50 m. In the direction (X-X) along the road, the light distribution curve of the lens is in a batwing shape and its light distribution angle ranges from 120 to 150 degrees; hence, it is capable of illuminating by the width of 6-7 lanes, and also capable of meeting the requirement of road illumination at an interval of 35 m between the lamp poles along the road; as a result, therefore the lens is applicable to road illumination of 6-7 lanes.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A method for greatly increasing the irradiation range of a street lamp or a high-pole lamp, comprising:

firstly, a COB module LED area light source is adopted as a light source;

secondly, the LED area light source is firstly put into an incident concave surface to be covered by the same, so that the LED point light source is primarily refracted by the incident concave surface; and thirdly, a light-distribution free curved surface is further arranged to cover the incident concave surface, so that the light ray primarily refracted by the incident concave surface is subsequently refracted by the light-distribution free curved surface to deflect by a large angle, wherein after two refractions, an included angle between a position, perpendicular to an extension direction of a road, of the peak intensity and an optical axis ranges from 60 to 75 degrees and a light distribution angle in a direction in accordance with the extension direction of the road ranges from 120 to 150 degrees, whereby the illumination of one single COB module LED point light source to at least 6 lanes and illumination at an interval of at least 35 m or long-distance illumination of a high-pole lamp are realized, the coordinate value of each point (x,y) on a section profile line, extending in the direction perpendicular to the extension direction of the road and passing the COB module LED point light source, of the light-distribution free curved surface is determined by the following light distribution condition of one single light ray:

$$\theta 2 = -\tan^{-1}\left\{\tan\xi 1 - \frac{(\alpha + 90^\circ)}{180^\circ} \cdot [\tan\xi 1 + \tan\xi 2]\right\}, \quad \text{Formula (1)}$$

wherein θ2 represents an included angle between an emergent ray and an optical axis OZ when an included angle between an incident ray OP and the optical axis OZ is α; OP represents the light ray OP emitted from the center point O of the COB module LED and incident into the incident concave surface (11); OZ represents an axis passing the center point O of the COB module LED and perpendicular to a mounting bottom surface thereof, a refracted ray PQ passes the light-distribution free curved surface for light distribution and is emergent as a light ray QS after light distribution; −ξ1 and ξ2 represent the maximum deflection angles expected to be obtained at the maximum light distribution angle of a marginal ray when the incident angle α is −90 degrees and +90 degrees, and the absolute values of the maximum deflection angles range from 60 to 75 degrees, the light distribution angle θ2 of the deflected emergent ray QS falls into a range of −ξ1 to ξ2; the positive and negative signs of the angles herein are defined as follows: a light ray deflecting toward the left of the optical axis OZ is negative, while a light ray deflecting toward the right of the optical axis OZ is positive; the numerical area of α ranges from −ξ1 to ξ2, the section profile line, extending in the direction perpendicular to the extension direction of the road and passing the COB module LED point light source, of the incident curved surface is composed of a segment of inclined elliptical arc A-B-C and a segment of arc C-D; the long axis of the elliptical arc A-B-C is OC, while the short axis thereof is OB, the value of the OC is 1-1.5 times the diameter of the area light source, the ratio OC/OB of the long axis to the short axis is between 1.2-2.5, the short axis OB has an inclination angle and an included angle between the short axis OB and the optical axis OZ is τ of which the numerical area ranges from 15 to 20 degrees, the arc is tangent with the inclined elliptical arc, the diagonal lines OL and OF, on a side close to A, of the incident concave surface are longer, while the diagonal lines OJ and OH, on a side close to D, of the same are shorter, and the ratio OL/OJ ranges from 1.1 to 1.3, the incident concave surface (11) and the light-distribution free curved surface (12) are formed by scanning the sectional curve along a curve determined according to the following condition:

$$\theta 1 = \tan^{-1}\left[\frac{\beta}{90^\circ} \cdot \tan\psi\right], \quad \text{Formula (2)}$$

wherein ψ represents the maximum light distribution angle of the edge ray required when the incident angle β of the incident concave surface (11) is +/−90 degrees, and the light distribution angle θ1 falls into a range from the included angle of the optical axis and +/−ψ; the positive and negative signs of the light angles are defined as the same herein: the light ray deflecting toward the left of the optical axis OZ is negative, while the light ray deflecting toward the right of the optical axis OZ is positive.

2. The method of claim 1, wherein:

the diameter of the COB module LED area light source is smaller than 30 mm.

3. A street lamp lens or a high-pole lamp lens capable of greatly increasing the irradiation range of a street lamp, comprising:

a COB module LED light source, wherein the COB module LED light source is covered with a primary incident concave lens which is covered with a light-distribution curved lens;

in a direction (Y-Y) perpendicular to a road, an included angle between a direction of a deflection angle of a light distribution curve of the light-distribution curved lens in a position of the peak intensity, and an optical axis ranges from 60 to 75 degrees, and in a direction (X-X) along the road, a light distribution angle of the light-distribution curved lens ranges from 120 to 150 degrees;

the coordinate value of each point (x,y) on a section profile line, extending in the direction perpendicular to the extension direction of the road and passing the COB module LED point light source, of the light-distribution curved lens is determined by the following light distribution condition of one single light ray:

$$\theta 2 = -\tan^{-1}\left\{\tan\xi 1 - \frac{(\alpha + 90^\circ)}{180^\circ} \cdot [\tan\xi 1 + \tan\xi 2]\right\} \quad \text{Formula (1)}$$

wherein θ2 represents an included angle between an emergent ray and an optical axis OZ when an included angle between an incident ray OP and the optical axis OZ is α;

OP represents the light ray OP emitted from the center point O of the COB module LED and incident into an incident concave surface (11);

OZ represents an axis passing the center point O of the COB module LED and perpendicular to a mounting bottom surface thereof;

a refracted ray PQ passes a light-distribution free curved surface (12) for light distribution and is emergent as a light ray QS after light distribution;

−ξ1 and ξ2 represent the maximum deflection angles expected to be obtained at the maximum light distribution angle of a marginal ray when the incident angle α is −90 degrees and +90 degrees, and the absolute values of the maximum deflection angles range from 60 to 75 degrees;

the light distribution angle θ2 of the deflected emergent ray QS falls into a range of −ξ1 to ξ2;

the positive and negative signs of the angles are herein defined as follows: a light ray deflecting toward the left of the optical axis OZ is negative, while a light ray deflecting toward the right of the optical axis OZ is positive;

the numerical area of α ranges from −ξ1 to ξ2; the section profile line, extending in the direction perpendicular to the extension direction of the road and passing the COB module LED point light source, of the primary incident concave lens is composed of a segment of inclined elliptical arc A-B-C and a segment of arc C-D;

the long axis of the elliptical arc A-B-C is OC, while the short axis thereof is OB; the value of the OC is 1-1.5 times the diameter of the area light source; the ratio OC/OB of the long axis to the short axis is between 1.2-2.5;

the short axis OB has an inclination angle and the included angle between the short axis OB and the optical axis OZ is τ of which the numerical area ranges from 15 to 20 degrees;

the arc is tangent with the inclined elliptical arc; the diagonal lines OL and OF, on a side close to A, of the incident concave surface (11) are longer, while the diagonal lines OJ and OH, on a side close to D, of the same are shorter, and the ratio OL/OJ ranges from 1.1 to 1.3;

the primary incident concave lens and the light-distribution curved lens are formed by scanning the sectional curve along a curve determined according to the following condition:

$$\theta 1 = \tan^{-1}\left[\frac{\beta}{90^\circ} \cdot \tan\psi\right] \qquad \text{Formula (2)}$$

wherein ψ represents the maximum light distribution angle of the edge ray required when the incident angle β of the incident concave surface (11) is +/−90 degrees;

the light distribution angle θ1 falls into a range from the included angle of the optical axis and +/−ψ; and the positive and negative signs of the light angles are defined as the same herein: the light ray deflecting toward the left of the optical axis OZ is negative, while the light ray deflecting toward the right of the optical axis OZ is positive.

4. The street lamp lens or the high-pole lamp lens capable of greatly increasing the irradiation range of the street lamp according to claim 1, wherein:

the light-distribution free curved surface is approximately 102.2092285 mm in width and approximately 50.8887939 mm in height, and the errors of all the dimensions are approximately +/−1 mm.

* * * * *